United States Patent [19]

Huguenin

[11] 3,981,003

[45] Sept. 14, 1976

[54] DIGITAL DISPLAY DEVICE

[75] Inventor: Freddy Huguenin, Lausanne, Switzerland

[73] Assignee: Ebauches S.A., Neuchatel, Switzerland

[22] Filed: Feb. 18, 1975

[21] Appl. No.: 550,175

[30] Foreign Application Priority Data

Mar. 22, 1974 Switzerland ..... 4010/74

[52] U.S. Cl. ..... 340/336; 340/146.3 FT; 340/146.3 Z; 340/324 R; 340/324 AD

[51] Int. Cl.$^2$ ..... G09F 9/32

[58] Field of Search ..... 340/146.3 A, 146.3 FT, 340/146.3 Z, 324 R, 336, 324 AD; 283/1

[56] References Cited

UNITED STATES PATENTS

| | | | |
|---|---|---|---|
| 1,267,640 | 5/1918 | Eagleston | 283/1 |
| 3,204,234 | 8/1965 | Nakauchi | 340/336 |
| 3,709,525 | 1/1973 | Frank | 283/1 |

*Primary Examiner*—Marshall M. Curtis
*Attorney, Agent, or Firm*—Anthony J. Casella

[57] ABSTRACT

A digital display device in which the digits 0, 1, 2 . . . . . 9 are formed by the combination of electrically activated elements. This device is characterized by the fact that the digits are all formed from a diagonal surface element comprising at least two superimposed portions, the upper portion of which is constant and is activated for the display of all the digits while the lower portion is activated or not, depending on the digit displayed.

12 Claims, 4 Drawing Figures

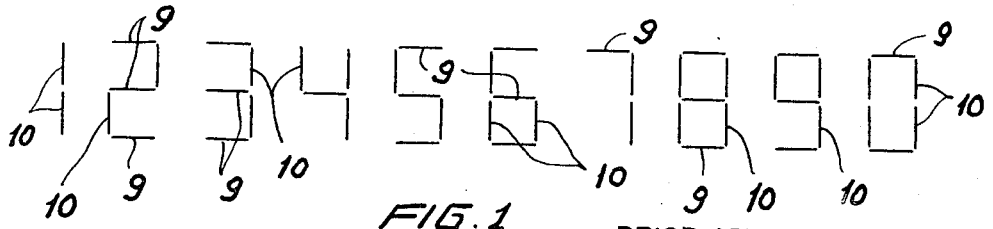
FIG. 1
PRIOR ART
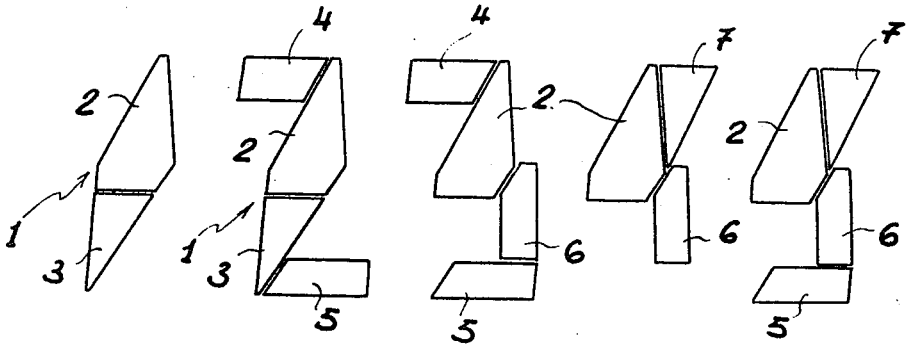
FIG. 2
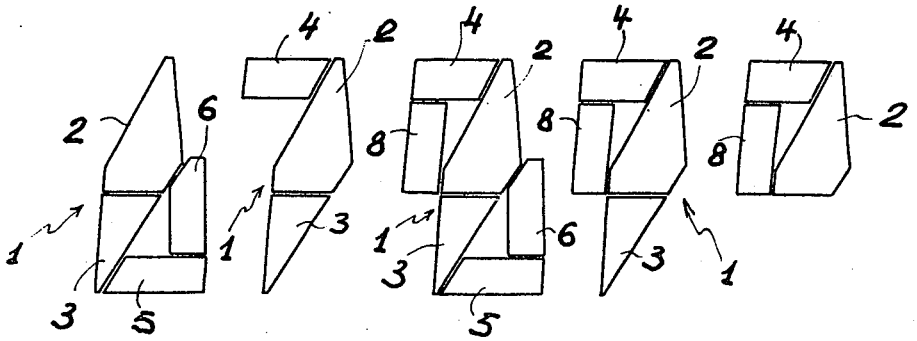

FIG. 3
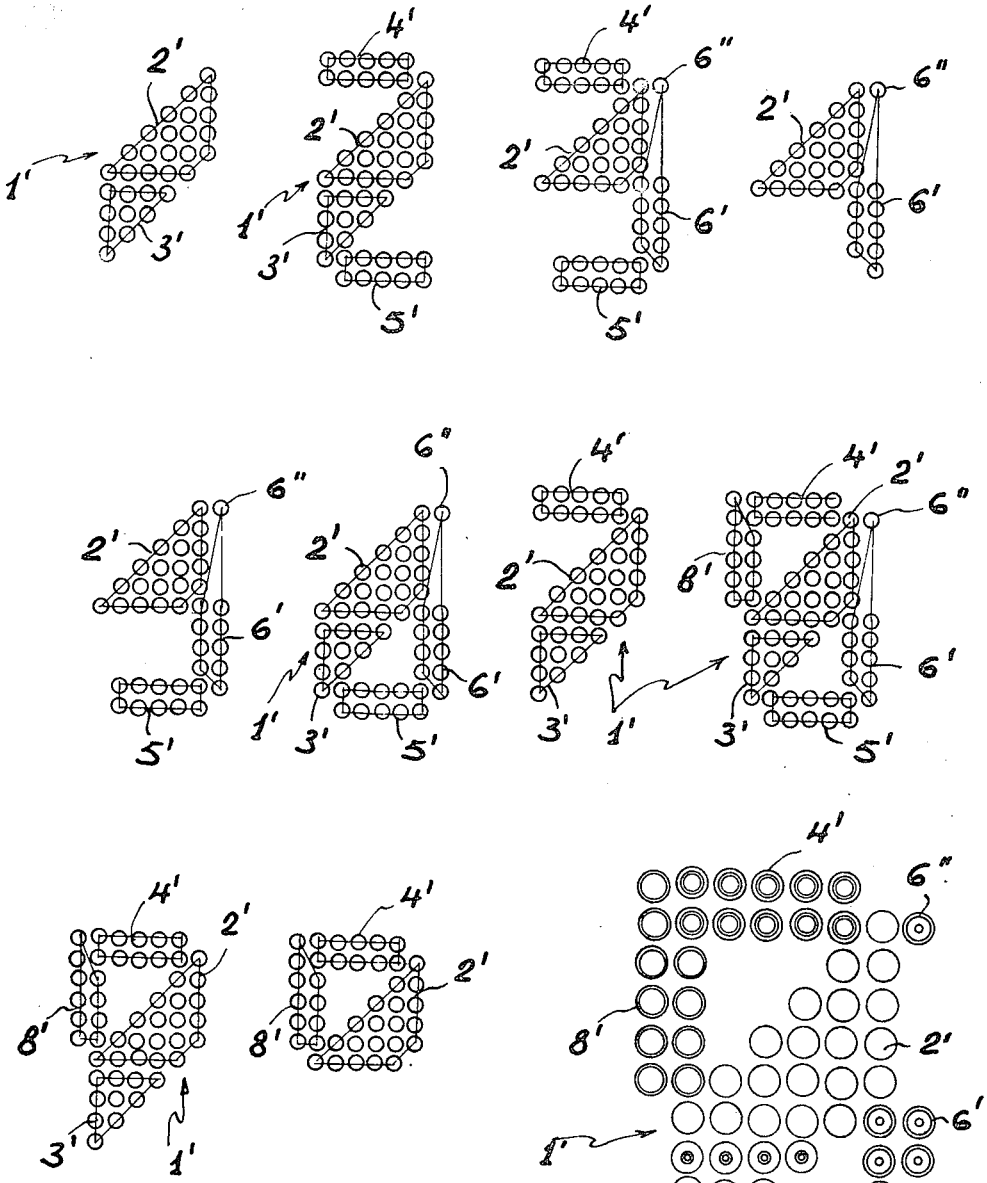
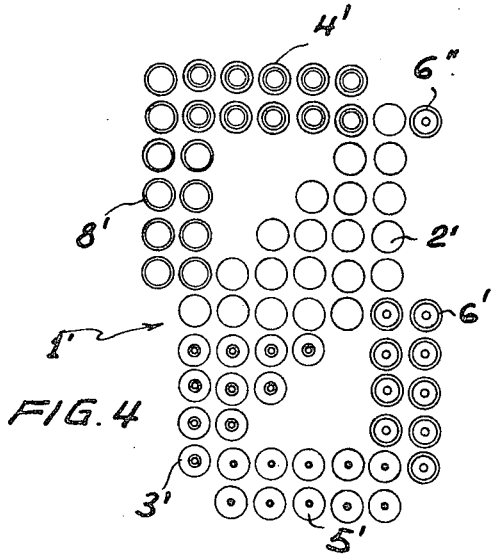
FIG. 4

DIGITAL DISPLAY DEVICE

The present invention relates to digital display devices in which the digits 0, 1, 2 . . . 9 are formed by the combination of electrically activated elements and each are formed by a line or a succession of dots. In these devices, each of the digits becomes visible as a result of the lighting up of certain elements and the passing from one digit to another digit is obtained, depending on the digits, by the extinction of certain elements accompanied by the simultaneous lighting up of other elements or by the extinction alone of certain elements, or else by the lighting up alone of other elements.

As a result of the arrangement itself of the elements forming the digits, the number of elements forming each digit is relatively high as is the number of operations necessary for the display of each of the digits, which somewhat complicates the display feed circuits and results in a substantial consumption of energy.

In order to overcome these drawbacks, the object of the present invention is a digital display device in which the digits 0, 1, 2 . . . 9 are formed by the combination of electrically activated elements, characterized by the fact that the digits 0, 1, 2, . . . 9 are all formed from a diagonal surface element comprising at least two superimposed portions, the upper portion of which is constant and is activated for the display of all the digits 0, 1, 2, . . . 9 while the lower portion is activated or not depending on the digit displayed.

The accompanying drawing shows, by way of example, two embodiments of the digits of the device in accordance with the invention.

FIG. 1 shows the digits from 1 to 0 of a conventional display;

FIG. 2 shows the digits from 1 to 0 of the first embodiment;

FIG. 3 shows the digits from 1 to 0 of the second embodiment;

FIG. 4 is an enlarged detail of FIG. 5.

In the different figures of the drawing the digits of the display device are shown by themselves. The feed and control circuits (lighting up and extinguishing) of the display device can be developed in any known manner. As these circuits do not form part of the invention, they have not been shown in order not needlessly to clutter the drawing.

The digits 1, 2, . . . 0 shown in FIG. 2 are all formed from a diagonal surface element 1. This diagonal surface element 1 which appears in its entirety on the digits 1-2-6-7-8-9 is formed of an upper portion 2 and of a lower portion 3. The upper portion 2 is constant and is activated and illuminated in order to form all the digits from 0 to 9 while the lower portion 3 is illuminated or extinguished depending on the digit which it is desired to display. Thus, for the digit one the two portions of the diagonal element 1 are illuminated; for the digit two this is also the case but at the same time an upper horizontal element 4 and a lower horizontal element 5 are illuminated; for the digit three, the lower portion 3 of the diagonal element is extinguished, the horizontal elements 4 and 5 are illuminated and at the same time a lower vertical element 6 is illuminated; for the digit four the lower portion 3 of the diagonal element and the horizontal elements 4 and 5 are extinguished while the lower vertical element 6 and a diagonal element 7 located in the extension of the upper portion 2 of the diagonal element 1 are illuminated; for the digit five there is the same combination of elements as for the digit 4, but in addition the lower horizontal element 5 is illuminated; for the digit six, the lower portion 3 of the diagonal element 1 as well as the lower horizontal element 5 and lower vertical element 6 are illuminated; for the digit seven, the lower portion 3 of the diagonal element 1 and the upper horizontal element 4 are illuminated; for the digit eight, the lower portion 3 of the diagonal element 1 is illuminated as well as the upper and lower horizontal elements 4 and 5, the lower vertical element 6 and an upper vertical element 8; the digit nine is formed in the same way as the digit seven but with the additional illuminating of the upper vertical element 8; finally, for the digit zero, only the upper horizontal element 4 and the upper vertical element 8 are illuminated, in addition of course to the illuminating of the upper portion 2 of the diagonal element 1.

It is thus seen that all the digits from 0 to 9 are formed from the upper portion 2 of the diagonal element 1, this being made possible by the fact that the element 1 is a surface element and that it is diagonal. There is thus the possibility of having an element which is common to all the digits and this common element, that is to say the upper portion 2 of the diagonal element 1, can therefore remain lit permanently or be printed permanently on the dial of the display device.

Referring to FIG. 1, which shows the digits from 1 to 0 of a conventional display, it is seen that these digits are all formed from seven horizontal and vertical elements 9 and 10 respectively which are parallel to each other. It will be noted that the vertical elements 10 may be slightly inclined but that they nevertheless remain parallel to each other. It is seen that as a result of this conventional arrangement, none of these seven elements is to be found in the formation of all the digits since the vertical elements necessarily form the sides of the parallelogram in which each of the digits is contained.

As we have previously seen, the upper portion 2 of the diagonal surface element may remain lit permanently or be printed permanently on the dial of the display device. In this way one avoids for this essential element the operations of lighting and extinction which are necessary in order to pass from one digit to the other, which results in a decrease in the amount of energy consumed by the display device and in a simplification of the feed and control circuits of the device.

Referring again to the conventional display of FIG. 1, it is seen that the successive display of all the digits from 1 to 0, as is for instance frequently the case in counting apparatus, requires twenty-eight operations for the lighting or extinction of the elements 9 and 10. On the other hand, since the upper portion 2 of the diagonal element 1 remains lit permanently and although the digits of the display device described are also formed from seven basic elements, the successive display of all the digits from 1 to 0 requires a total of only twenty operations of lighting or extinguishing of the elements 3 to 8. It will also be noted that this reduction in the number of lighting and extinguishing operations is present when individually passing from one digit to the other, that is to say from the digit 1 to the digit 2, from the digit 2 to the digit 3, etc., these individual transfers requiring at most three operations instead of five, as in the case of the conventional display.

This will also constitute a saving in energy, particularly in cases in which a display by electrochromism is used.

In the example described, the diagonal surface element 1 is formed of two portions 2 and 3 of unequal areas. This however is not necessary and these two portions may be of equal area. It is even possible to divide the diagonal surface element into more than two portions, for instance into three portions of equal or unequal areas. As surfaces are concerned it will in all cases be possible to select the proportions of these surfaces in such a manner as to obtain the most favorable illumination relationships or even constant illumination which will make it possible to simplify the feeding of the said elements.

In the example shown, the elements which combine with the diagonal surface element 1 are also formed by surfaces. This however is not necessary and these elements may be linear. Similarly, the surface elements and in particular the diagonal surface element may be solid or formed of dots or a raster.

The digits shown in FIG. 3 are formed by dots the combination of which forms the different surface elements. In the drawing the dots have been greatly enlarged and in order to facilitate understanding the groups of dots forming each of the elements have been surrounded by a line. It is thus seen that the diagonal surface element 1' is formed of an upper portion 2' and of a lower portion 3', the upper portion 2' being constant and being activated for the forming of all the digits. There can also be noted the upper horizontal element 4' and the lower horizontal element 5' and the lower vertical element 6' and upper vertical element 8'. In this embodiment, the diagonal element 7 located in the extension of the upper portion of the diagonal element 1 and used for the forming of the digits 4 and 5 in the example of FIG. 1 will not appear. This element is replaced by a dot 6''. It will be noted that this dot 6'' also appears on the digits three, six, and eight.

Referring to FIG. 4 which represents the digit eight of the embodiment of FIG. 3 but greatly enlarged, it is seen that the dots of each element are designated in the same manner in order to distinguish dots of the other elements. These dots are all of the same diameter and for each of the elements 3', 4', 5', 6', and 8' there is the same number of ten dots, which gives each of the said elements a total area equal to that of each of the other elements. With respect to the element 6', the dot 6'' constitutes one of the dots of this element but it is separated from the other dots of the said element and is present further up. This dot 6'' thus makes it possible to complete the digit five and as it is a portion of the element 6' it appears whenever the element 6' is activated, i.e. for the digits, three, four, five, six, and eight.

Referring still to FIG. 4, it is seen that the constant element 2' consists of twenty dots, which gives it an area twice that of each of the other elements.

One can thus effect numerous combinations which will make it possible to obtain practically all desired relationships of illumination.

I claim:

1. A digit display device in which each of the digits 0, 1, 2 . . . 9 is formed by a combination of elements, said device comprising:

a. an upper horizontal element and a lower horizontal element, said horizontal elements appearing or not depending on the digit displayed, b. a substantially vertical left upper element and a substantially vertical right lower element, said substantially vertical elements appearing or not depending on the digit displayed; and c. a diagonal surface element, said diagonal surface element comprising at least two superimposed portions of which the upper portion is common to all of the digits 0, 1, 2 . . 0. 9 and appears for the display of each of said digits, while the lower portions thereof appears or not depending on the digit displayed.

2. A device according to claim 1, wherein said upper portion of the diagonal surface element appears permanently.

3. A device according to claim 1, wherein said upper portion of the diagonal surface element is permanently printed on the device.

4. A device according to claim 1, wherein said diagonal surface element is formed of at least two portions of unequal surface area.

5. A device according to claim 1, wherein said diagonal surface element is formed of at least two portions of equal surface area.

6. A device according to claim 1, wherein said horizontal and substantially vertical elements are formed of surfaces.

7. A device according to claim 1, wherein said horizontal and substantially vertical elements are linear.

8. A device according to claim 1, wherein said diagonal surface element is solid.

9. A device according to claim 6, wherein said horizontal and substantially vertical elements are formed of surfaces which are solid.

10. A device according to claim 1, wherein said diagonal surface element is formed of a raster.

11. A device according to claim 6, wherein said horizontal and substantially vertical elements are formed of surfaces which are constituted by a raster.

12. A device according to claim 1, wherein said elements are formed of dots.

* * * * *